US008739451B2

(12) United States Patent
Nelson

(10) Patent No.: US 8,739,451 B2
(45) Date of Patent: Jun. 3, 2014

(54) QUICK RELEASE AMMUNITION CONNECTOR ASSEMBLY

(76) Inventor: Matthew Nelson, Phelan, CA (US)

( * ) Notice: Subject to any disclaimer, the term of this patent is extended or adjusted under 35 U.S.C. 154(b) by 0 days.

(21) Appl. No.: 13/489,456

(22) Filed: Jun. 6, 2012

(65) Prior Publication Data

US 2012/0311911 A1 Dec. 13, 2012

Related U.S. Application Data

(60) Provisional application No. 61/495,864, filed on Jun. 10, 2011.

(51) Int. Cl.
*F41C 27/00* (2006.01)

(52) U.S. Cl.
USPC ..... 42/90; 224/931; 220/23.4

(58) Field of Classification Search
USPC ..... 42/49.01, 49.02, 50, 90; 206/3; 224/931; 220/23.4
See application file for complete search history.

(56) References Cited

U.S. PATENT DOCUMENTS

| | | | | |
|---|---|---|---|---|
| 4,484,403 | A * | 11/1984 | Schwaller | 42/50 |
| 5,279,059 | A * | 1/1994 | Howard | 42/90 |
| 6,327,805 | B1 | 12/2001 | Clifton, Jr. | |
| 6,644,488 | B1 * | 11/2003 | Coleman | 220/23.4 |
| 6,668,479 | B1 | 12/2003 | Obong | |
| 6,874,266 | B1 | 4/2005 | Kong | |
| 7,073,285 | B2 | 7/2006 | Obong | |
| 7,497,043 | B2 | 3/2009 | Clifton, Jr. et al. | |
| 7,562,482 | B1 * | 7/2009 | Johnson | 42/90 |
| 8,011,544 | B1 * | 9/2011 | Howell | 224/668 |
| 2010/0263255 | A1 * | 10/2010 | Harris | 42/90 |
| 2011/0107645 | A1 * | 5/2011 | Faifer | 42/90 |

* cited by examiner

*Primary Examiner* — Gabriel Klein

(57) ABSTRACT

An apparatus for holding a plurality of ammunition magazines in a stacked arrangement. The apparatus is configured to allow a magazine not in use in the stack to be disconnected from the stack while allowing a magazine engaged in the weapon to remain in place. The device comprises a clip located on one magazine sleeve that reversibly connects to a latch located on a second magazine sleeve. A magazine can comprise a latch on one side and a clip on an opposite side to permit stacks of more than two ammunition sleeves with magazines to be constructed. The clip and latch can be designed to provide variable spacing or staggering of magazines in order to adapt to weapons where space limitations require alternative configurations.

18 Claims, 5 Drawing Sheets

QUICK RELEASE AMMUNITION CONNECTOR ASSEMBLY

CROSS REFERENCE TO RELATED APPLICATION

This application claims the benefit under 35 U.S.C. §119 (e) of U.S. Provisional Application No. 61/495,864, filed Jun. 10, 2011, and entitled "Quick Release Ammunition Magazine Connector Assembly", the entirety of which is hereby incorporated by reference.

FIELD OF THE INVENTION

The field of the invention relates to weapon accessories, and in particular to apparatus and methods related to ammunition magazines.

BACKGROUND

In the field of firearms and related types of weapons two ever-present problems concerning a user are, the rate of firing of ammunition, and the supply of ammunition. In addressing the problem of the rate of firing of weapons, a variety of designs including semi-automatic and automatic weapons have been produced. Compared to single shot weapons, these weapons increase the number of rounds that can be fired in the course of a given time period by significantly reducing the time interval between the firing of successive rounds.

However, despite the success of these designs, they still suffer from the problem of maintaining a supply of ammunition to the user of the weapon. In some instances, conveyor like systems, such as those used in vintage WWI and WWII machine guns can supply ammunition at a rate sufficient to allow the user to "fire at will." While this solves the problem of ammunition supply in a generic sense, in general these conveyor-like systems are not portable and thus only practically useful where the weapon is positioned in a fixed location. It is frequently desirable that weapons be portable since mobility is an important aspect of modern weapon use.

Others have attempted a variety of solutions to the ammunition supply problem, including designing ammunition boxes that hold a large number of rounds. For example, U.S. Pat. No. 4,753,155 (Balister) describes an ammunition box capable of holding up to 300 rounds of ammunition and which delivers the ammunition directly to the feed tray of the weapon.

Still others have attempted to solve the supply problem by connecting ammunition magazines to each other. For example, U.S. Pat. No. 6,327,805 (Clifton, Jr.) describes a device that secures two ammunition magazines together. The magazines are engaged by mounting brackets that are then attached to each other by screws.

U.S. Pat. Nos. 6,668,479 and 7,073,285 (Obong) describe devices for holding a plurality of firearm magazines. The device comprises multiple compartments formed by two halves of a bracket structure, each of which is configured to accept a magazine. Like the '805 patent discussed above, the Obong device secures the magazines in the holder by means of a screw that clamps the bracket halves together.

U.S. Pat. No. 6,874,266 (Kong) describes a device to provide storage of a firearm cartridge within the cavity of a handgun grip.

U.S. Pat. No. 7,497,043 (Clifton Jr.) describes a device to hold two magazines together at different heights.

Despite these attempts, the prior art has yet to provide an ammunition magazine system in which magazines that are otherwise unstackable can be stacked together to provide a larger number of rounds of ammunition to a user. Further, the prior art solutions all suffer from the limitation that magazines are not readily swappable so that a user can exchange a spent magazine for a full one, without having to remove the magazine currently engage in the weapon.

SUMMARY OF THE INVENTION

Various objects, features, aspects and advantages of the inventive subject matter will become more apparent from the following detailed description of preferred embodiments, along with the accompanying drawing figures in which like numerals represent like components.

While the prior art addresses some of the issues related to supplying additional ammunition to a user, they all suffer from the same problem in that they are not well suited for exchanging spent magazines for fresh ones while allowing for continued use of the weapon. In particular, none of the prior art devices allow a user to exchange one magazine, while another is engaged and in available for use in the weapon.

Because of the limitations of the prior art with respect to ammunition magazine holders, it is an object of the present invention to provide a magazine holder that allows a user to have ready access to multiple ammunition magazines, and to allow the user to quickly and easily exchange spent or partially spent magazines without having to disengage a useable magazine from the weapon.

In some embodiments, the invention comprises a plurality of sleeves, each sleeve adapted to receive and hold an ammunition magazine. Each sleeve further comprises a connecting mechanism to reversibly connect one ammunition sleeve to another, allowing magazines to be laterally stackable.

In some embodiments, the connecting mechanism comprises a clip and latch structure configured to connect one sleeve to another. A clip attached to a first sleeve slides into a slot within a latch structure attached to a second sleeve. The clip can include tabs at either or both ends, the tabs designed to engage the edges of the latch in order to secure the two sleeves to each other.

The clip and latch can be designed such that the tab or tabs can be snapped into place within the latch. The result is that sleeves thus connected are held in a substantially secure position relative to each other. The tab and latch can be further designed to allow for relatively quick release, even while a magazine is engaged within the weapon for use. Thus, a user can quickly disengage a spent magazine, engage an adjacent magazine having ammunition, and continuing firing with minimum or no loss of time. When convenient, the spent magazine can be quickly swapped out for a fresh one, without having to make the weapon unavailable for firing. By mounting a clip and a latch on opposite sides of a magazine sleeve, it is possible to create stacks of ammunition magazines in virtually any number that might be desired.

Therefore, in some embodiments, the present invention provides, an apparatus for holding a plurality of ammunition magazines for use with a firearm, the device comprising: a plurality of magazine sleeves, wherein each magazine sleeve comprises an outer surface, an inner surface, and an opening configured to receive an ammunition magazine; each magazine sleeve further comprises at least one of a clip and a latch located on the outer surface of the magazine sleeve; wherein the clip and the latch are configured to be reversibly connectable to each other; wherein a clip located on a first magazine sleeve is configured to reversibly engage a latch located on a second magazine sleeve; wherein, when the clip on the first magazine sleeve engages the latch located on the second magazine sleeve, the first and second magazine sleeves form a stack; and wherein sleeves in a stack are substantially prevented from moving relative to each other.

In some embodiments, at least one magazine sleeve comprises both a clip and a latch, wherein the clip and the latch are located substantially opposite each other on the at least one magazine sleeve. In some embodiments, at least one magazine sleeve further comprises an ammunition magazine secured in the sleeve.

In some embodiments, the clip and latch are configured to be reversibly connectable when an ammunition magazine located in a magazine sleeve is engaged in a weapon.

In some embodiments, the inner surface of a magazine sleeve is configured to resist removal of an ammunition magazine from the magazine sleeve.

In some embodiments, the stack comprises more than two magazine sleeves.

In some embodiments, the clip further comprises: a clip body having first and second ends and an axial profile; at least one tab located at an end of the clip body; the latch further comprises: a slot, wherein the slot further comprises an opening having an axial profile substantially similar to the axial profile of the clip body; wherein the clip is configured to reversibly slide within the slot, and wherein, when the clip is slid into the slot, the at least one tab engages an edge of the latch and secures the clip to the latch.

In some embodiments, the clip body comprises a tab located at both the first and second ends.

In some embodiments, at least one of a clip and a latch is located on an article worn by a user.

In some embodiments, the invention provides a method of using an apparatus holding a plurality of ammunition magazines for use with a firearm, the method comprising: providing a plurality of magazine sleeves, each magazine sleeve comprising an outer surface, an inner surface, and an opening configured to receive an ammunition magazine; wherein each magazine sleeve further comprises at least one of a clip and a latch located on the outer surface of the magazine sleeve; wherein the clip and the latch are configured to be reversibly connectable to each other; wherein a clip located on a first magazine sleeve is configured to engage a latch located on a second magazine sleeve; engaging the clip on the first magazine sleeve with the latch located on the second magazine sleeve to form a stack.

In some embodiments of the method, at least one magazine sleeve comprises both a clip and a latch, wherein the clip and the latch are located substantially opposite each other on the at least one magazine sleeve.

In some embodiments, the method further comprises placing an ammunition magazine secured in at least one magazine sleeve.

In some embodiments, the method further comprises performing at least one of connecting and disconnecting a magazine sleeve to the stack, while an ammunition magazine is engaged in a weapon.

In some embodiments, the method further comprises providing a magazine sleeve in which the inner surface of the magazine sleeve is configured to resist removal of an ammunition magazine from the magazine sleeve.

In some embodiments, the method further comprises forming a stack having more than two magazine sleeves.

In some embodiments, the method further comprises providing a clip, wherein the clip comprises: a clip body having first and second ends and an axial profile; at least one tab located at an end of the clip body; providing a latch, wherein the latch comprises: a slot, wherein the slot further comprises an opening having an axial profile substantially similar to the axial profile of the clip body; wherein the clip is configured to slide within the slot such that the at least one tab is able to engage an edge of the latch and be operative to secure the clip to the latch; and sliding the clip into the latch and securing the clip and latch by engaging the latch with the at least one tab.

In some embodiments, the method further comprises providing a clip body, wherein the clip body comprises a tab located at both the first and second ends.

In some embodiments, the method further comprises locating at least one of a clip and a latch on an article worn by a user.

BRIEF DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numerals, and where:

DETAILED DESCRIPTION

The following discussion provides examples of embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

Those of skill in the art will recognize that the described embodiment are examples of possible configurations of the invention, and are not intended to be limiting to the scope of the invention. Accordingly, the drawings and descriptions contained herein are to be regarded as illustrative of the invention as set forth in the accompanying claims.

These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

Unless the context dictates the contrary, all ranges set forth herein should be interpreted as being inclusive of their endpoints, and open-ended ranges should be interpreted to include commercially practical values. Similarly, all lists of values should be considered as inclusive of intermediate values unless the context indicates the contrary.

In some embodiments, as depicted in FIGS. 1-4, the invention comprises a apparatus that permits the attachment of ammunition magazines to each other in order to increase the number of rounds of ammunition readily available to a user. In some embodiments, a sleeve 10 is configured to receive an ammunition magazine 20. As is readily apparent from the figures, each magazine sleeve 10 will form an opening into which an ammunition magazine 20 can be placed. The orientation of the opening of the magazine sleeve will define a central axis 1, the central axis corresponding substantially to the axis alone which an ammunition magazine 20 will be inserted in to the sleeve 10, and which can be seen to be substantially perpendicular to the to and bottom edges of the magazine sleeve. It is to be understood that where reference is made to a magazine, it is intended to mean a magazine positioned within a sleeve of the present invention. Where the term sleeve is used, it can be assumed that the sleeve may or may not have a magazine situated within it. Neither is to be limiting to the scope of the invention.

Figure 1:
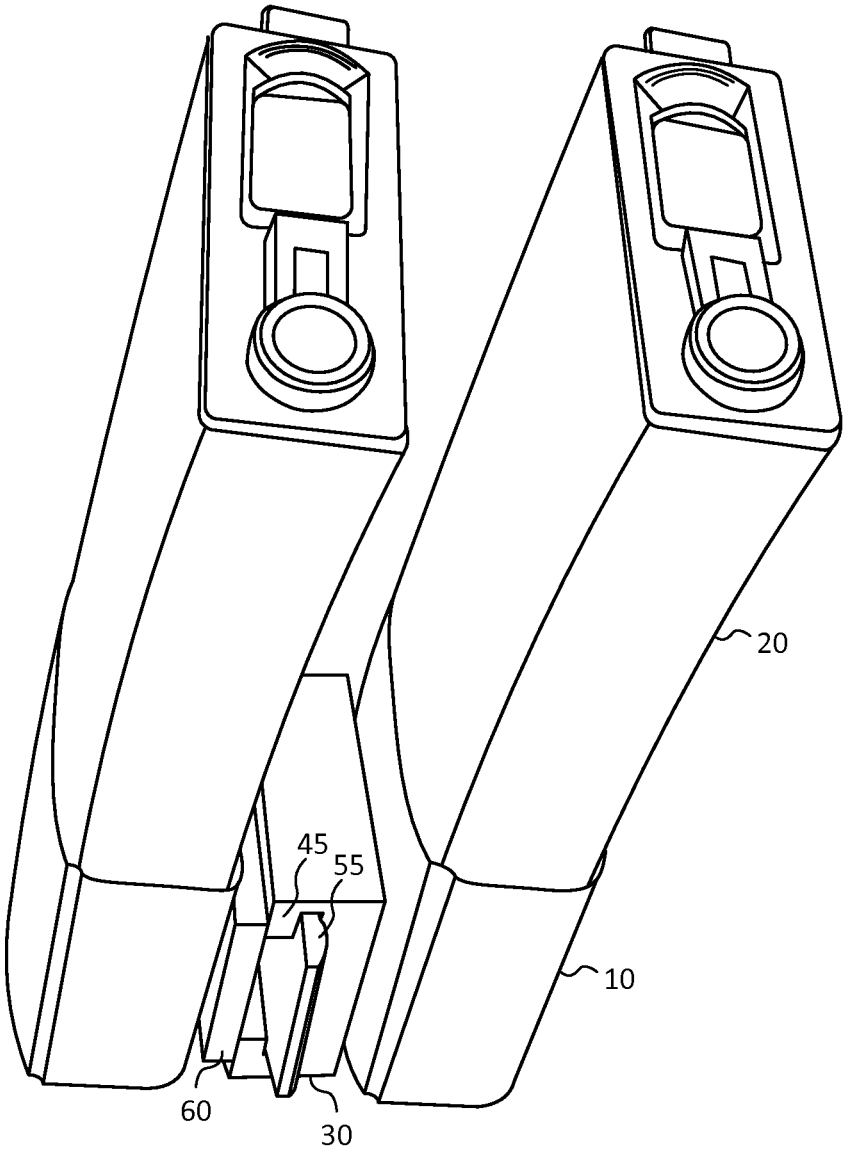
FIG. 1 is a perspective view of an embodiment depicting two ammunition magazines held in sleeves connected together with the clip and latch arrangement of the present invention.
Figure 2:
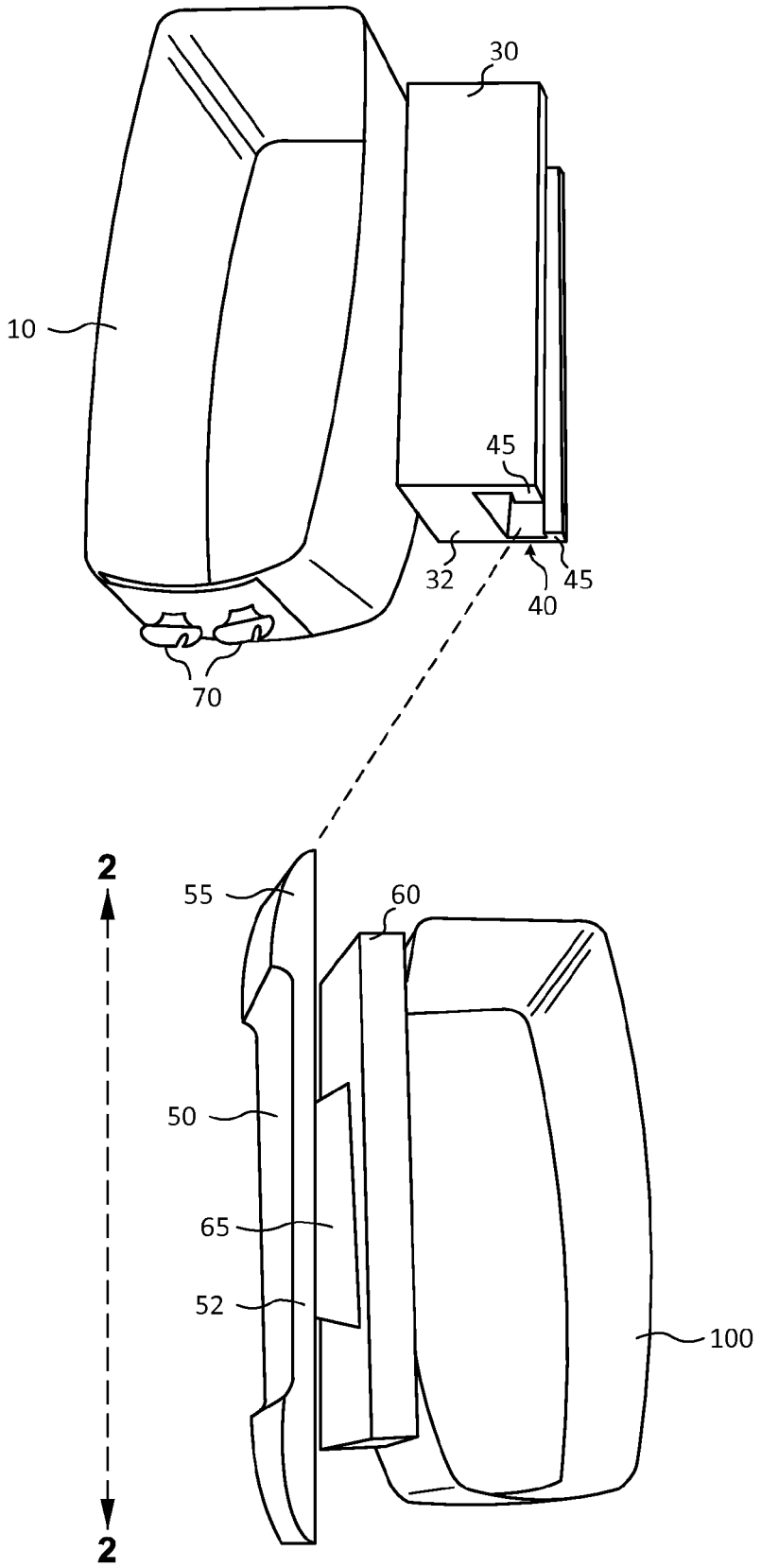
FIG. 2 depicts an embodiment of the present invention where two sleeves are disconnected from each other. The top panel depicts a sleeve attached to a latch, while the bottom panel depicts a sleeve attached to a clip. The dotted line provides a sense of how the clip may be inserted into the latch.

In some embodiments, the sleeve 10 may include fasteners 70 (See FIG. 2; top panel). In this type of arrangement the sleeve may be designed to be expandable to allow placement of the magazine within the opening of the sleeve, and then constricted followed by tightening of the fastener to maintain the magazine in place within the sleeve.

In some embodiments the dimensions of a sleeve 100 can be selected to closely match the magazine such that the magazine can be held in place within the sleeve by simple friction (See FIG. 2 bottom panel). For ease of distinguishing between the two, the magazines have been omitted in FIG. 2. Those of skill in the art will readily appreciate how the magazine is to be held in place in the sleeve in either of these possible configurations. In some cases, the inner surface of the sleeve may be textured or coated with a material such as rubber or foam or other suitable materials in order to improve the contact and securing of the magazine within the sleeve. Magazine sleeves are well known in the art, and a variety of different shape and size magazines are compatible with the apparatus of the invention.

While each sleeve will preferably comprise a securing means adapted to secure a magazine within a sleeve, in order to prevent the magazine from inadvertently slipping out of the sleeve while in use, the precise nature of the securing means can vary depending on the specific design and structure of the magazine being used. Those of skill in the art will recognize that a wide array of fastening mechanisms may be useful in conjunction with the present invention. Thus, the precise manner in which the magazine is maintained within a sleeve is not intended to limit the scope of the invention.

The invention further comprises complementary portions of a clip 50 and latch 30 attached to sleeves 20. The clip 50 and latch 30 are configured to reversibly engage each other in order to connect sleeves to each other. As shown in FIG. 2 a clip 50 can comprise a clip body 52. In the illustrated embodiment, the clip body 52 further comprises a tab 55 at either or both ends of the body. In some embodiments, the clip body 52 can be secured to a clip base 60 via a support pillar 65. In some embodiments the clip body 52 can be secured directly to the clip base 60 without the need for an intervening pillar. In some embodiments, it is possible to secure the clip body 52 directly to the sleeve 10 without the need for an intervening pillar or base. It yet other embodiments, it may be desirable to secure the clip directly to the sleeve.

The inclusion or exclusion of a pillar or clip base will depend on a number of factors, including the spacing required between adjacent magazines. This will in turn depend in part on the design of the magazines being used, as well as the structural features of the weapon. It will be obvious to those of skill in the art that a pillar and/or base may be optional, and thus their dimensions or presence are not considered to be limiting to the scope of the invention.

Also shown in FIG. 2, a latch 30 comprises a latch body 32, slot 40, and rails 45. The rails are generally parallel to each other and which run substantially the length of the latch body 32. The slot 40 is operative to receive the clip body 52. As can be seen from the figures, some embodiments provide that when connecting two sleeves holding magazines, a clip can be slid into the slot formed in the latch body. The rails provide the advantage of overhanging the slot so that the clip is maintained within the channel formed by the slot, and further preventing the clip from being pulled from the latch portion except be disengaging the clip and sliding the clip back out of the slot. The tab(s) 55 can be conveniently shaped to be able to overhang and engage the end of the slot 40 so that the tab(s) 55 will click into place to better secure the clip to the latch. The dashed line in FIG. 2 is intended to depict that the clip can be inserted into the latch to secure two sleeves to each other.

Conveniently, the clip body 52 can be fashioned from a resilient flexible material that tends to return to a pre-determined shape when deformed. Thus the clip body can be bent to allow entry and passage through the slot 40, but will snap back into its pre-deformed shape thereby engaging an inner aspect of the tab against the edge of the latch body, thus better securing the clip and latch together.

Figure 3A:
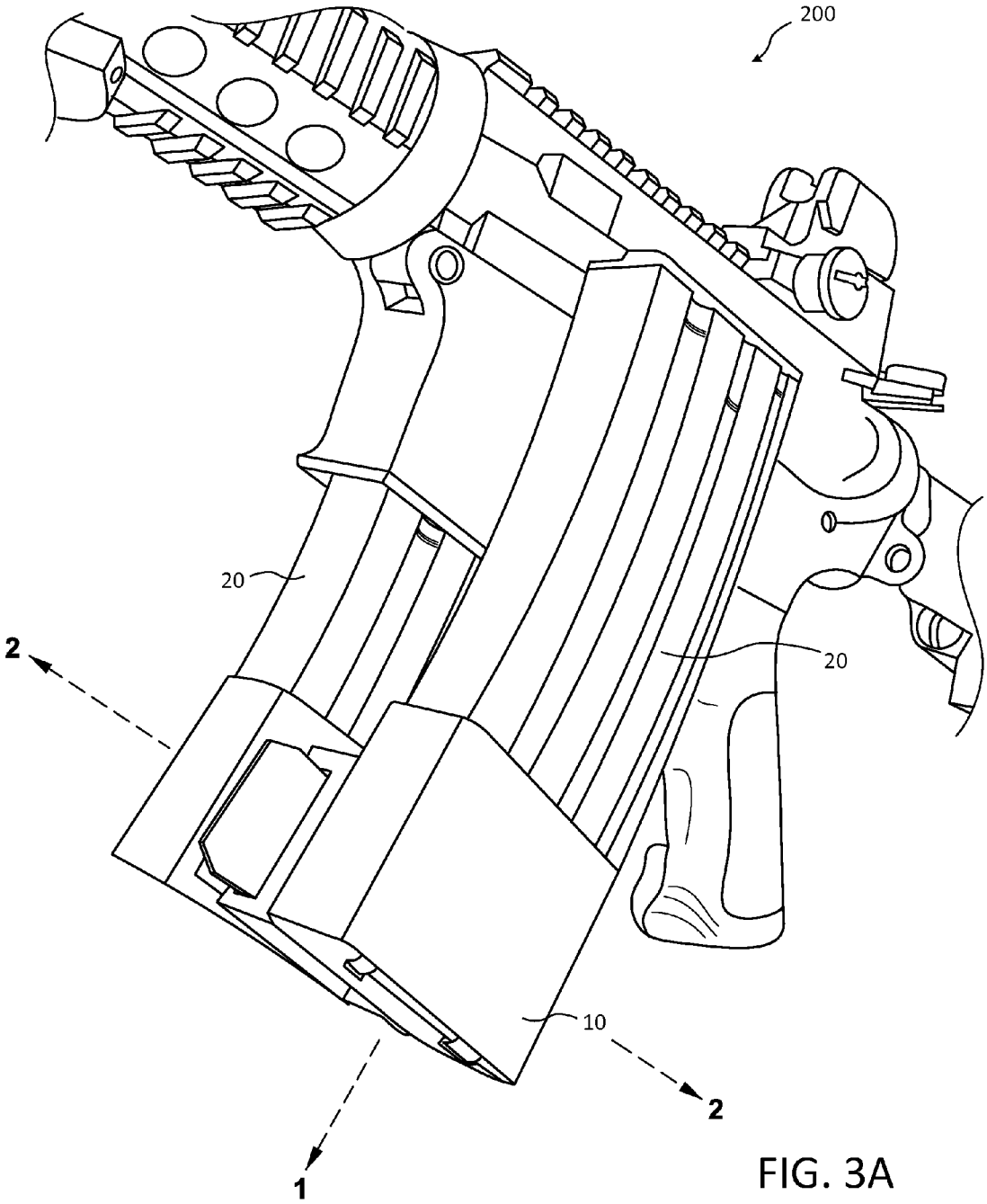
FIG. 3A depicts an embodiment where two magazines in sleeves are connected by the latch and clip mechanism of the present invention, and one of the magazines is engaged in the weapon ready for firing.
Figure 3B:
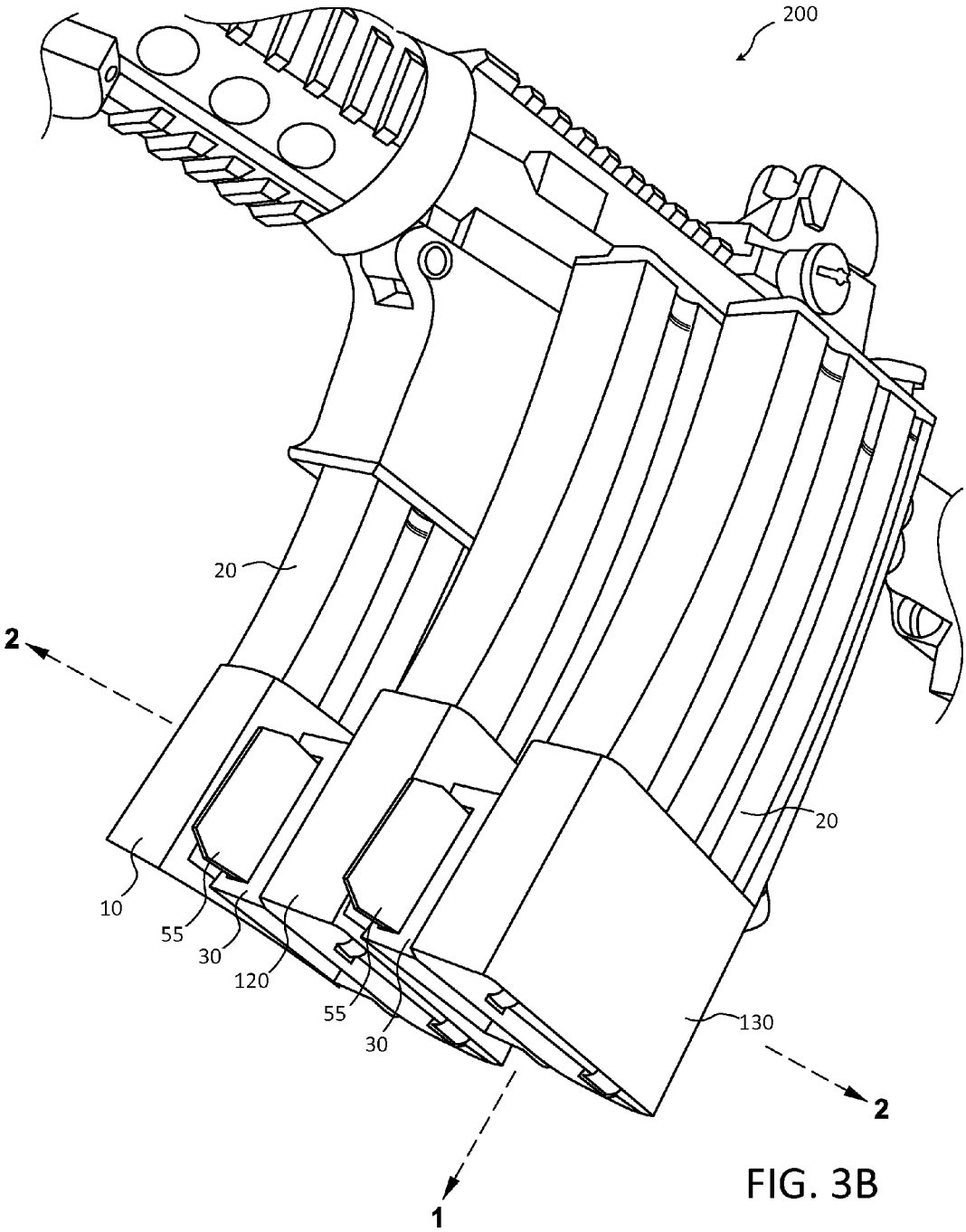
FIG. 3B depicts an embodiment where three magazines in sleeves are connected by latch and clip mechanisms of the present invention, and one of the magazines is engaged in the weapon ready for firing
Figure 4:
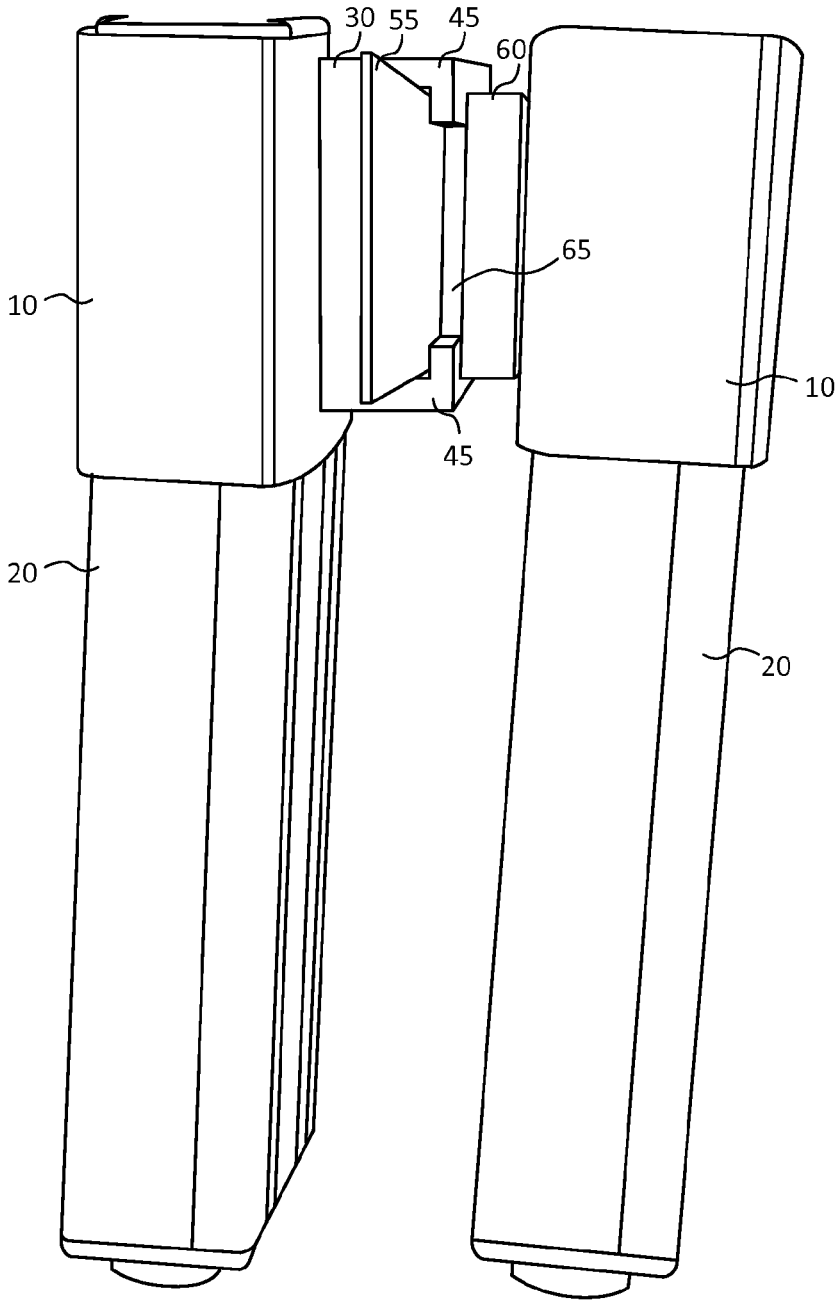
FIG. 4 depicts an embodiment of the present invention, where two magazines in sleeves are connected to each other via a clip and latch mechanism.

The net effect is that a number of ammunition magazines can be connected one to another, in effect creating a "stack" of ammunition magazines. FIG. 3A depicts a stack of two magazines used in conjunction with a weapon. As shown in FIG. 3B, it is also possible to provide a sleeve 120 that comprises a clip on one side, and a latch on the opposite side, such that an additional sleeve 130 can be added to increase the number of magazines in the stack. FIG. 3B shows a stack of three magazines, but by repeating the above design, stacks of 2, 3, 4 or more sleeves are possible. It will also be readily appreciated that adding or removing a magazine sleeve from a stack will be accomplished by engaging the clip and latch on adjacent sleeves and applying a force in a direction 2 substantially perpendicular to the central axis 1 of the sleeve.

Conveniently, the modular design of the present invention allows a stack to be separated between any two sleeves without having to remove the sleeve that is engaged in the weapon. For example, it is apparent that sleeve 120 and 130 could be removed as their own sub-stack without having to remove the magazine 20 located in sleeve 10 from the weapon. Thus, not only can individual sleeves and magazines be added or removed form the stack, but multiple sleeves and magazines may be removed and replaced in a single action.

It is also readily apparent that providing sleeves comprising both a clip and latch, located substantially on opposite sides of the sleeve, allows a user to configure a stack of magazines in whatever number desired. Furthermore, providing sleeves with both a clip and a latch oriented as describe would permit a user to "build" a stack by adding sleeves to the right or left. This provides the advantage of the apparatus effectively being "ambidextrous" simplifying its use for either left handed or right handed users.

In some embodiments the slot 40 is of generally uniform width, as would be the clip body 52. However, it may be desirable in other embodiments to provide a slot that is tapered, or comprises engagement surfaces at some point along the length of the slot. In a design like this (not shown) the functional tab(s) might be placed along the side of the clip body 52, rather than at the ends as shown. Further, other engagement devices other than tabs are possible for use with embodiments of the present invention. For example, it would be possible to provide a device where engagement was via a spring-loaded ball bearing included in one part of the clip-latch device that fits into a similarly shaped complimentary depression formed in the complimentary part. The types of engagements and clips that are useful with the present invention are varied and will be readily appreciated by those of skill in the art. The shape of the slot is similarly not limited. Any suitable shape of slot can be produced, as long as the axial profile of the opening is substantially similar to the axial profile of the clip such that the clip effectively engages the slot.

As discussed above, in some embodiments the clip portion of the device can be made from a flexible material, such that to engage and disengage the clip, applying a bias force to one or the other tab disengages that tab from the latch. This in turn would allow the clip to be slid out of the slot, and the two adjacent sleeves disconnected from each other. Reversing the process allows the user to re-connect the sleeve magazine, or to connect a new sleeve to one already in use.

In some embodiments, the tab may further comprise a triggering mechanism such as a button and lock arrangement. Thus, pressing a button on the tab would place the tab in an "open" configuration to allow the release of one magazine from another. Pressing the button again, or sliding the clip into place within the slot could be effective to release the trigger and engage a tab in the latch.

In general the clip and latch mechanism can be designed to be secure enough to prevent inadvertent disengagement of a sleeve/magazine when the device is in use, but not so secure as to prevent relatively easy and rapid connection and disconnection. In some embodiments, the clip and latch mechanism is readily operated by one hand, leaving the other hand free to maintain the weapon in a position to engage a target as soon as possible after loading a fresh magazine.

It will be apparent to those of skill in the art that the spacing of magazine can be varied. It will generally be desirable to have magazines as close together as possible to make the overall configuration as compact as possible, while recognizing that a certain minimum spacing will be required so that an adjacent magazine does not interfere with the ability to insert its neighboring magazine into the weapon, or to interfere with normal operation of the weapon. Design features of particular weapons may dictate the arrangement of sleeves in a stack, although it will be obvious to users how to most efficiently make use of the present invention with virtually any weapon. A primary advantage of the invention is that it makes otherwise unstackable magazines, now stackable.

It may be further possible to produce an ammunition magazine in which the clip and latch are included as part of the magazine structure, thus obviating the need for a separate sleeve. In such an embodiment, magazines would directly connect to each other via an embodiment of the clip and latch system as described herein.

As discussed above, the design of the present invention allows for "ambidextrous" use. Therefore, regardless of whether the user is right or left handed, the invention will work equally well for the user. Accordingly, it is possible to attach or remove a magazine from a stack of interconnected magazines from either the left or right side, whichever one prefers. A user might also prefer to add fresh magazines to the left side, and remove them from the right, in effect creating a conveyor effect. Methods like these would allow for a user to develop a standardized system of use that would ensure that the next magazine to be inserted into the weapon would contain ammunition.

Further, it may be desirable to add magazines in groups of two or more, rather than singly. The design of the invention further allows a user to pre-configure a stack of magazines before beginning operation of the weapon. In some cases a user may choose to connect two magazines together. In other cases it may be desirable and useful to connect three or more magazines together.

A primary advantage of the present invention is that it permits multiple magazines to be fastened together so that the user has ready access to a fresh magazine for reloading. It also provides a method of having additional ammunition at the ready in preparation for use of the firearm. In prior art systems additional ammunition is generally stored on the person of the user, for example on a belt. Reloading a fresh magazine requires the user to remove the expended one, finding a fresh one, and then inserting the fresh one into the weapon, potentially diverting attention away from the target of interest. The need to re-load a weapon may not always be at a convenient time, and the time taken to reload can subject the user to an increased risk of exposure to opposing fire due to being unable to defend one's self during the reloading process. This is especially true for cases where the user is involved in the tactical use of the firearm, as would be the case in military applications, or in competitive shooting events such as paintball type games.

In some embodiments, a clip and/or latch compatible with the invention could be located on an article worn by the user, for example an ammunition belt. In this way, the sleeve could be easily removed from a storage location, and then added to the stack while the weapon remains available for use. A spent ammunition magazine in a sleeve could be easily removed and discarded or replaced on the belt or other article where ammunition is stored in order to reuse the magazine at a later time.

The present invention significantly reduces the time during which a user is unable to use their weapon, and this reduces the inherent risk of harm due to temporarily being unarmed while reloading. In contrast, it is possible with the present invention to continue firing the weapon while switching out expended magazines and replacing them with fresh ones.

The invention also provides that more rounds of ammunition can be made readily available, reducing the number of times a user would have to resort to going to an ammunition belt or like system in order to access more ammunition. Yet another advantage is that in cases where time permits, a user can remove one or more sleeves holding expended magazine(s) with one or more fresh ones, without having to disengage a still useable magazine from the weapon. In this way a user can effectively continually ensure they have the maximum number of available rounds for firing always at the ready within a stack of magazines.

Depending on the weapon with which the invention is to be used, there may be variations in the detailed construction in order to maximize the adaptability of the device, without departing from the spirit of the invention. For example, when used with the AR15/M16, the magazine on the right side might preferably be situated lower than the one on the left side so that it does not interfere with the chamber. In some cases, this could be accommodated by offsetting the clip/latch fastening system such that each magazine was staggered with the right-side magazine of two adjacent magazines being positioned slightly lower than the left one.

In some cases, the distance between magazines may be varied. For example, an example of the invention suitable for use with the M1A/M14 would have a relatively wider spacing between magazines as these weapons generally have a thicker magazine well than do other similar Weapons. As a result, in some embodiments the device would be adapted to allow for a greater spacing between magazines, in order to account for the relatively thicker wooden stock around the magazine well of this particular weapon. To vary the distance, in one embodiment the support pillar might be increased or decreased in size, or omitted altogether. Alternatively, the clip and latch could be constructed with particular dimensions in order to yield a desired spacing between adjacent magazine sleeves and the ammunition magazines they are holding In other cases, such as the FN-FAL type weapon, the chamber opening is on the right side, while the charging handle is on the left side. As a result, a stack of magazines would be positioned so that the extra magazine is on the right side.

The SMG/Carbine has magazines with less surface area, and the invention allows for the use of a modified fastening system to insure that magazines are securely connected.

There are also a number of advantages to the use of the present invention as compared to the prior art "clamp" or "cinch" mechanisms that have been designed for use in connecting multiple magazines. For example the prior art clamp or cinch type devices are typically designed to hold only a specific and pre-determined number of magazines together, usually two. In the present invention, sleeves can be made to have a clip on one side and a latch on the opposite site so that multiple magazines can be stacked together. In theory the number of magazines is limitless. In practice, the number of magazines a user will want to stack together will depend on factors such as weight and the effect of the bulk of multiple magazines on the handling of the weapon.

Another problem with prior art devices is that they require frequent adjusting. For example the clamp devices require screwing and unscrewing of the clamp structure in order to replace a magazine. This is simply not a practical solution when engaged in live fire in the field. In contrast, the present invention requires no adjustment during use. Magazines are simply clipped in and out as needed, and the once attached are held securely in place by the design of the clip and latch structures. Similarly, the clip and latch assembly of the present invention provides more secure attachment than do prior art methods and apparatus.

The present invention can be readily adapted to accept magazines currently on the market. Therefore, a user does not need to purchase new magazines in order to fit the invention but can simply make use of the ones they already have. As discussed above, in some embodiments it is possible to provide an assembly that is adjustable, so that a generic device could be supplied that would be readily adaptable to a range of magazine shapes and sizes.

The present invention is also readily adapted to attaching magazine stacks to other objects such as stocks, rails, belts, or virtually any other gear, permitting a user to customize ammunition storage to suit their own preferences.

It should also be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. An apparatus for holding a plurality of ammunition magazines for use with a firearm, the apparatus comprising:

a plurality of magazine sleeves, wherein each magazine sleeve comprises a top edge, a bottom edge, an outer surface, an inner surface, and an opening therethrough, the opening configured to receive an ammunition magazine;

wherein the opening further comprises a central axis, the central axis extending through the opening and oriented substantially perpendicular to the top edge and the bottom edge of the magazine sleeve such that an ammunition magazine can be inserted through the opening in a direction aligned with the central axis;

wherein a first magazine sleeve of the plurality of magazine sleeves comprises a clip located on the outer surface of the first magazine sleeve and a second magazine sleeve of the plurality of magazine sleeves comprises a latch located on the outer surface of the second magazine sleeve;

wherein the clip and the latch are configured to be reversibly connectable to each other;

wherein the clip located on the first magazine sleeve is configured to reversibly engage the latch located on the second magazine sleeve;

wherein, when the clip on the first magazine sleeve engages the latch located on the second magazine sleeve, the first and second magazine sleeves form a stack;

wherein the sleeves in the stack are substantially prevented from moving relative to each other;

wherein each magazine sleeve is configured such that an ammunition magazine located in each magazine sleeve is disposed such that each ammunition magazine can be engaged in a magazine well of the firearm such that the contents of the respective magazine are available for feeding into a firing chamber of the firearm; and wherein each magazine sleeve is configured to be added to or removed from the stack by application of a force to one of the magazine sleeves in a direction substantially perpendicular to the central axis of said one of the magazine sleeves.

2. The apparatus of claim 1, wherein at least one magazine sleeve comprises both a clip and a latch, wherein the clip and the latch are located substantially opposite each other on the at least one magazine sleeve.

3. The apparatus of claim 1, wherein at least one magazine sleeve further comprises an ammunition magazine secured in the sleeve.

4. The apparatus of claim 3, wherein the clip and latch are configured to be reversibly connectable when an ammunition magazine located in a magazine sleeve is engaged in a weapon.

5. The apparatus of claim 1, wherein the inner surface of a magazine sleeve is configured to resist removal of an ammunition magazine from the magazine sleeve.

6. The apparatus of claim 1, wherein the stack comprises more than two magazine sleeves.

7. The apparatus of claim 1, wherein:

the clip further comprises:

a clip body having first and second ends and an axial profile;

at least one tab located at an end of the clip body;

the latch further comprises:

a slot, wherein the slot further comprises an opening having an axial profile substantially similar to the axial profile of the clip body;

wherein the clip is configured to reversibly slide within the slot, and wherein, when the clip is slid into the slot, the at least one tab engages an edge of the latch and secures the clip to the latch.

8. The apparatus of claim 7, wherein the clip body comprises a tab located at both the first and second ends.

9. The apparatus of claim 1, wherein at least one of a clip and a latch is located on a article worn by a user.

10. A method of using an apparatus holding a plurality of ammunition magazines for use with a firearm, the method comprising:

providing a plurality of magazine sleeves, each magazine sleeve comprising a top edge, a bottom edge, an outer surface, an inner surface, and an opening therethrough, the opening configured to receive an ammunition magazine;

wherein the opening further comprises a central axis the central axis extending through the opening and oriented substantially perpendicular to the top edge and the bottom edge of the magazine sleeve such that an ammunition magazine can be inserted through the opening in a direction aligned with the central axis;

wherein a first magazine sleeve of the plurality of magazine sleeves comprises a clip located on the outer surface of the first magazine sleeve and a second magazine sleeve of the plurality of magazine sleeves comprises a latch located on the outer surface of the second magazine sleeve;

wherein the clip and the latch are configured to be reversibly connectable to each other;

wherein the clip located on the first magazine sleeve is configured to engage the latch located on the second magazine sleeve;

engaging the clip on the first magazine sleeve with the latch located on the second magazine sleeve to form a stack; and wherein each magazine sleeve is configured such that an ammunition magazine located in each magazine sleeve is disposed such that each ammunition magazine can be engaged in a magazine well of the firearm such that the contents of the respective magazine are available for feeding into a firing chamber of the firearm; and wherein each magazine sleeve is configured to be added to or removed from the stack by application of a force to one of the magazine sleeves in a direction substantially perpendicular to the central axis of the opening of said one of the magazine sleeves; and adding or removing a magazine sleeve from the stack by applying a force to a magazine sleeve perpendicular to the central axis of the opening.

11. The method of claim 10, wherein at least one magazine sleeve comprises both a clip and a latch, wherein the clip and the latch are located substantially opposite each other on the at least one magazine sleeve.

12. The method of claim 10, further comprising placing an ammunition magazine secured in at least one magazine sleeve.

13. The method of claim 12, further comprising performing at least one of connecting and disconnecting a magazine sleeve to the stack, while an ammunition magazine in the stack is engaged by the firearm.

14. The method of claim 10, further comprising providing a magazine sleeve in which the inner surface of the magazine sleeve is configured to resist removal of an ammunition magazine from the magazine sleeve.

15. The method of claim 10, further comprising forming a stack having more than two magazine sleeves.

16. The method of claim 10, further comprising:

providing a clip, wherein the clip comprises:

a clip body having first and second ends and an axial profile;

at least one tab located at an end of the clip body;

providing a latch, wherein the latch comprises:

a slot, wherein the slot further comprises an opening having an axial profile substantially similar to the axial profile of the clip body;

wherein the clip is configured to slide within the slot such that the at least one tab is able to engage an edge of the latch and be operative to secure the clip to the latch; and sliding the clip into the latch and securing the clip and latch by engaging the latch with the at least one tab.

17. The method of claim 16, further comprising providing a clip body, wherein the clip body comprises a tab located at both the first and second ends.

18. The method of claim 10, further comprising locating at least one of a clip and a latch on an article worn by a user.

* * * * *